US008837765B2

(12) United States Patent
Lin

(10) Patent No.: US 8,837,765 B2
(45) **Date of Patent: *Sep. 16, 2014**

(54) TUNABLE EARPHONE

(71) Applicant: Cheng Uei Precision Industry Co., Ltd., New Taipei (TW)

(72) Inventor: You Ruei Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/740,273

(22) Filed: Jan. 14, 2013

(65) Prior Publication Data

US 2014/0198940 A1 Jul. 17, 2014

(51) Int. Cl.
*H04R 25/00* (2006.01)
*H04R 1/28* (2006.01)

(52) U.S. Cl.
CPC ..... *H04R 1/2807* (2013.01)
USPC ..... 381/373; 381/371; 381/372; 381/380

(58) Field of Classification Search
CPC .... H04R 1/1016; H04R 1/1058; H04R 1/083; H04R 1/1091; H04R 2460/09; H04R 2460/11
USPC ..... 381/312–331, 370–373, 380; 181/129–130
See application file for complete search history.

(56) References Cited

U.S. PATENT DOCUMENTS 8,422,717 B2 * 4/2013 Lin et al. ..... 381/372
2007/0125590 A1 * 6/2007 Oberdanner ..... 181/135

* cited by examiner

*Primary Examiner* — Matthew Eason
(74) *Attorney, Agent, or Firm* — Cheng-Ju Chiang

(57) ABSTRACT

A tunable earphone includes a speaker for making sound, a shell receiving the speaker and defining a resonance cavity therein, and a tunable element rotatably and removably mounted on the shell. The shell has a top thereof recessed downward to form a receiving cavity. A supporting plate is formed at a bottom of the receiving cavity. A damping vent is opened in the supporting plate to connect the resonance cavity with the receiving cavity. The tunable element defines a through hole passing therethrough and aligned with the damping vent of the shell. A damping plate is integrally molded on a bottom of the tunable element. The damping plate is located in the receiving cavity and against the supporting plate to separate between the damping vent and the through hole for smoothening the frequency response of the sound pressure level in the resonance cavity while the speaker making sound.

4 Claims, 5 Drawing Sheets

TUNABLE EARPHONE

BACKGROUND OF THE INVENTION

1. Field of the Invention

The present invention relates to an earphone, and more particularly to a tunable earphone.

2. The Related Art

An earphone connected with a music player can help the user enjoying music and not affecting others. FIG. 1 shows a conventional tunable earphone 100'. The tunable earphone 100' includes a shell 10' enclosing a resonance cavity 11', and a speaker 20' accommodated in the shell 10'. A top of the shell 10' has a through hole 12' interconnecting the resonance cavity 11' with the outside region. A damping plate 30' is fixed inside the shell 10' and blocks the though hole 12' in order to smoothen the frequency response of the sound pressure level in the resonance cavity 11' while the speaker 20' making sound. So, the sound effect becomes better. However, as the damping plate 12' is fixed in the shell 10', users cannot change the damping plate 12' while users want to change the sound effect. Therefore, it is necessary to provide a new tunable earphone which is capable of changing the damping plate easily, for the convenience of users enjoying different sound effects according to their own preference.

SUMMARY OF THE INVENTION

An object of the present invention is to provide a tunable earphone. The tunable earphone includes a speaker for making sound, a shell receiving the speaker and defining a resonance cavity therein, and a tunable element rotatably and removably mounted on the shell. The shell has a top thereof recessed downward to form a receiving cavity. A supporting plate is formed at a bottom of the receiving cavity. A damping vent is opened in the supporting plate to connect the resonance cavity with the receiving cavity. The tunable element defines a through hole passing therethrough and aligned with the damping vent of the shell. A damping plate is integrally molded on a bottom of the tunable element. The damping plate is located in the receiving cavity and against the supporting plate to separate between the damping vent and the through hole for smoothening the frequency response of the sound pressure level in the resonance cavity while the speaker making sound.

As described above, the damping plate is integrally molded on the bottom of the tunable element, and then the tunable element together with the damping plate is rotatably and removably mounted on the shell. As the damping plates made of different materials have the different sound effects, it is convenient for users to change the sound effect by changing the tunable elements integrally molded with different damping plates. So, the user can enjoy different sound effects by only changing the tunable element.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
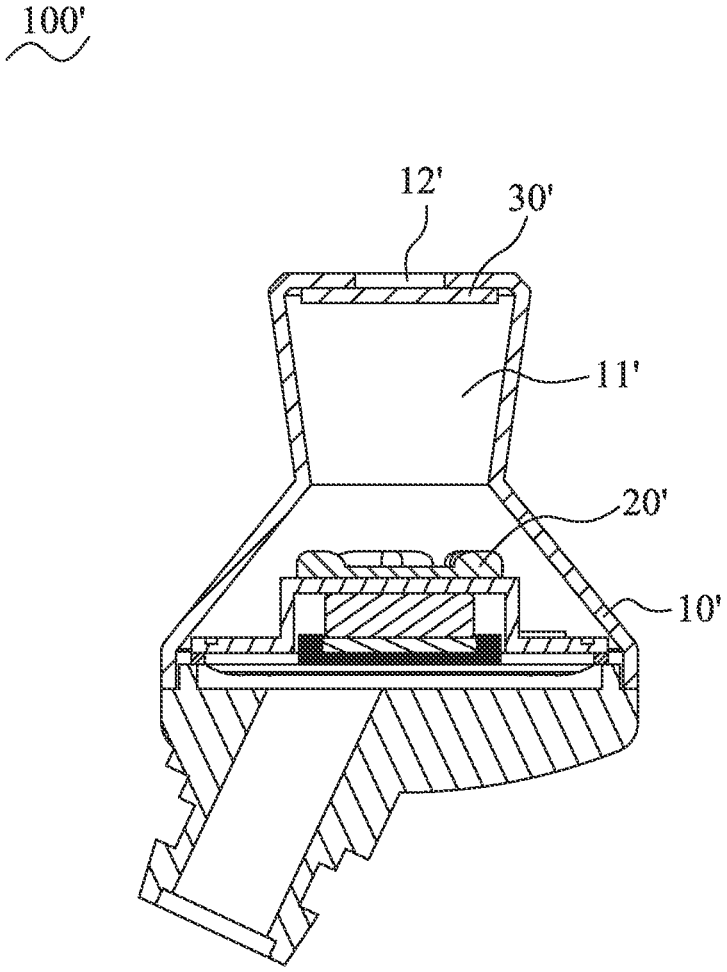
FIG. 1 (Prior Art)
FIG. 1 is an assembled cross-sectional view of a conventional tunable earphone.
Figure 2:
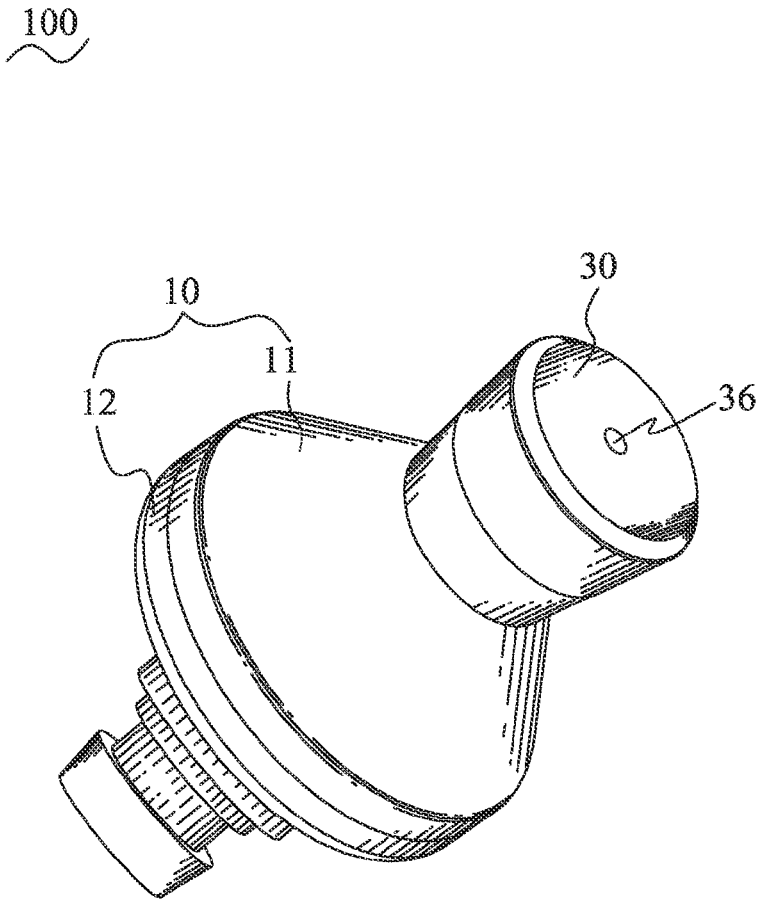
FIG. 2 is an assembled perspective view of a tunable earphone according to an embodiment of the present invention.

Referring to FIGS. 2-5, a tunable earphone 100 according to an embodiment of the present invention is shown. The tunable earphone 100 includes a shell 10, a speaker 20 accommodated in the shell 10 for making sound, and a tunable element 30 rotatably and removably assembled on the shell 10.

The shell 10 defines a resonance cavity 101 therein, and has a top thereof recessed downward to form a receiving cavity 111. A supporting plate 112 is formed at a bottom of the receiving cavity 111. A damping vent 113 is opened in the supporting plate 112 to connect the resonance cavity 101 with the receiving cavity 111. The tunable element 30 defines a through hole 36 passing therethrough and aligned with the damping vent 113 of the shell 10. A damping plate 37 is integrally molded on a bottom of the tunable element 30. The damping plate 37 is located in the receiving cavity 111 and against the supporting plate 112 to separate between the damping vent 113 and the through hole 36 for smoothening the frequency response of the sound pressure level in the resonance cavity 101 while the speaker 20 making sound.

Figure 3:
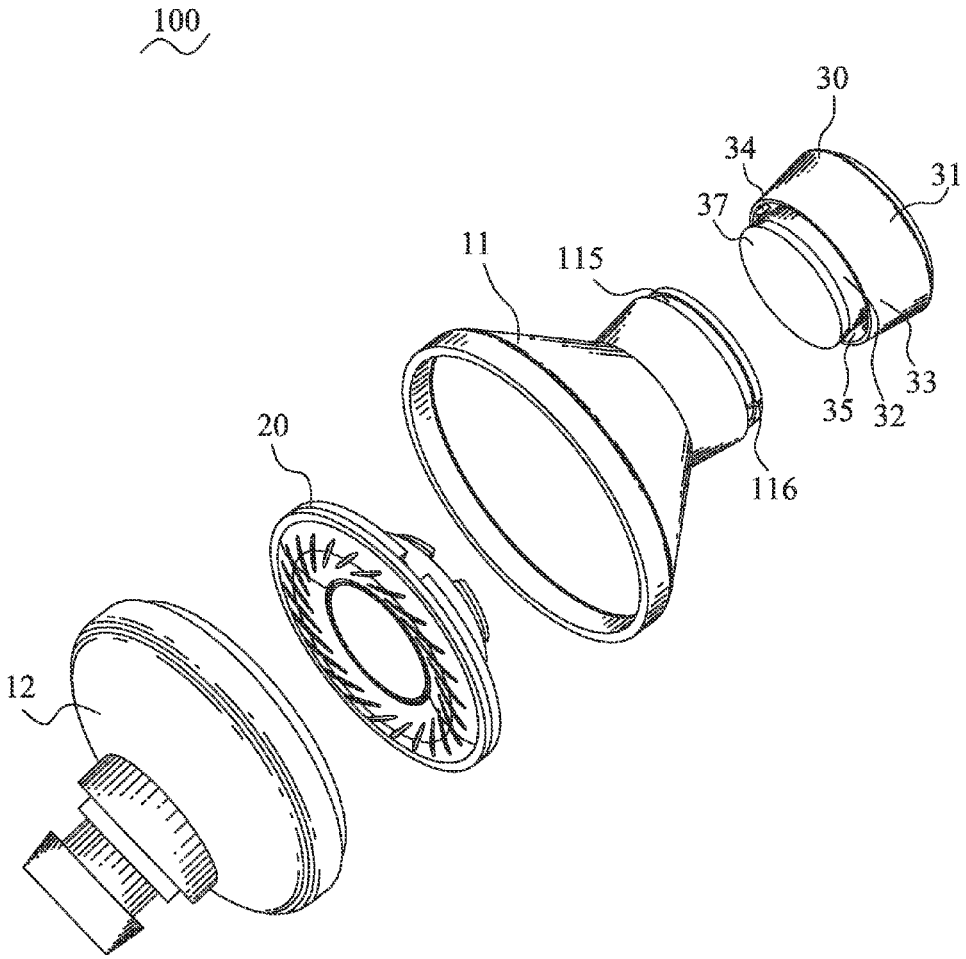
FIG. 3 is an exploded perspective view of the tunable earphone of FIG. 2.
Figure 4:
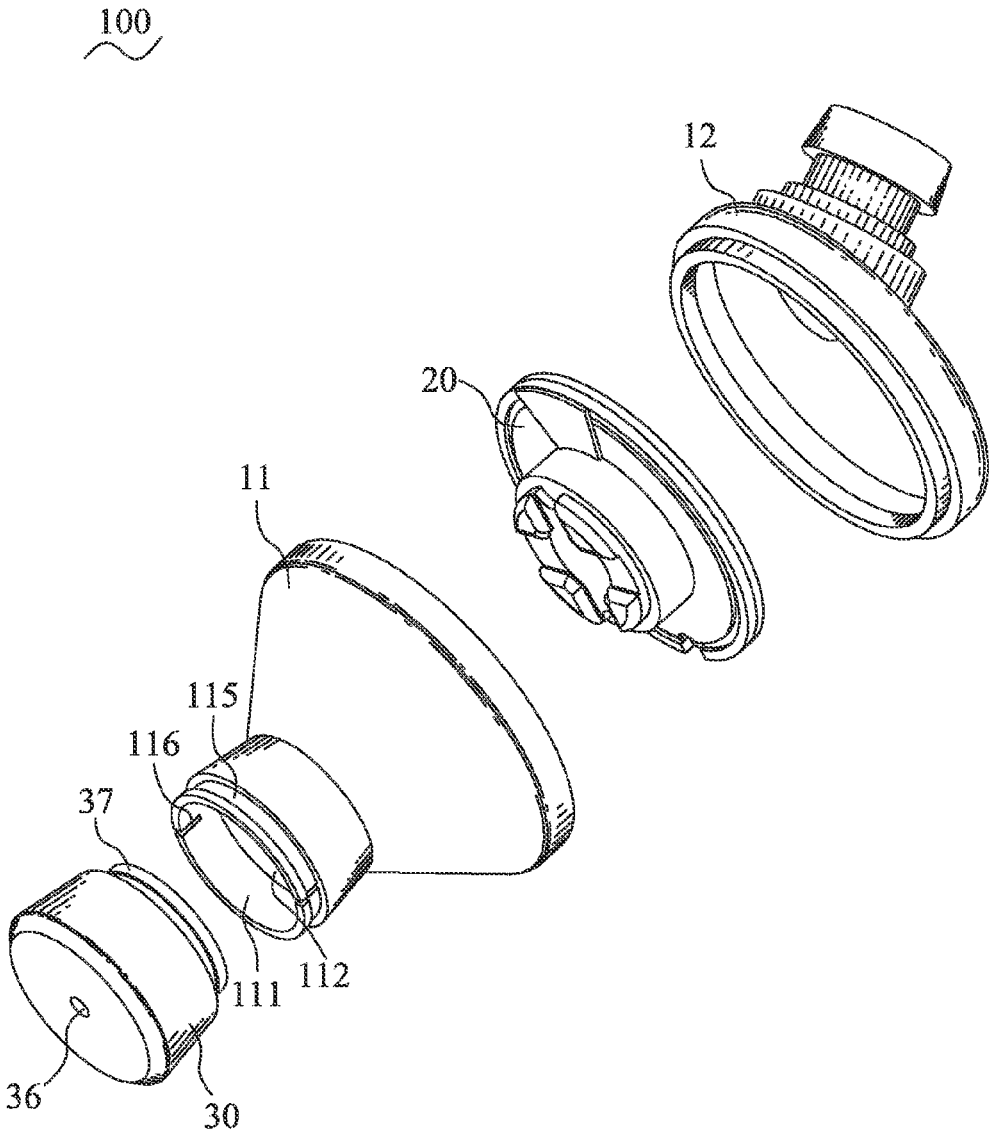
FIG. 4 is another angle of exploded perspective view of the tunable earphone of FIG. 2.
Figure 5:
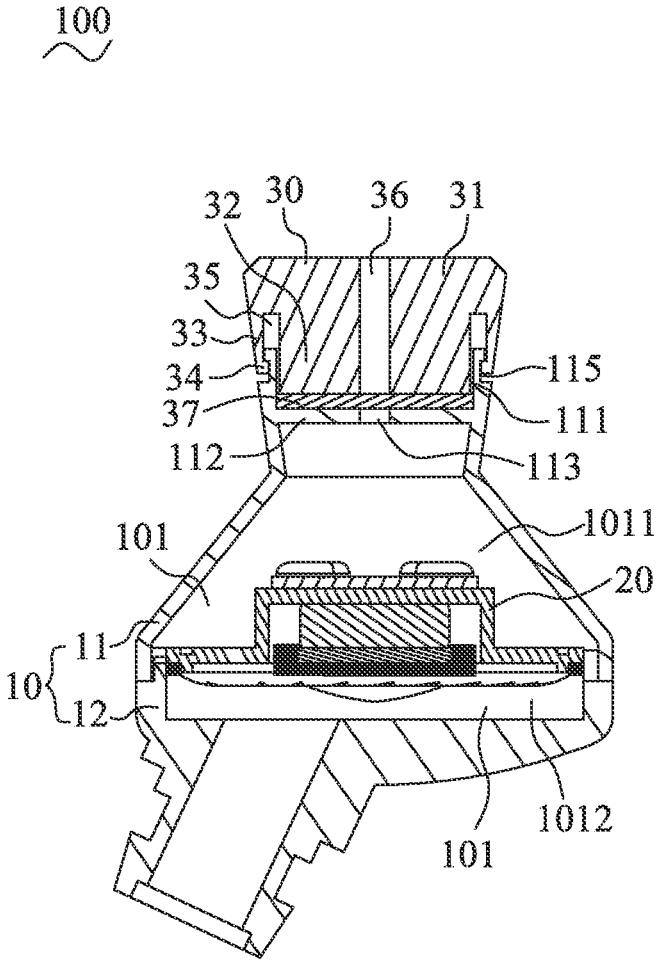
FIG. 5 is an assembled cross-sectional view of the tunable earphone of FIG. 2.

Referring to FIG. 3, FIG. 4 and FIG. 5, the shell 10 includes a bass shell 11 and a high shell 12 coupled with the bass shell 11. The resonance cavity 101 is divided into a bass cavity 1011 formed between the speaker 20 and the bass shell 11, and a high cavity 1012 formed between the speaker 20 and the high shell 12. The receiving cavity 111 is formed in the top of the bass shell 11.

Referring to FIG. 3, FIG. 4 and FIG. 5 again, the tunable element 30 has a base 31. The middle of a bottom of the base 31 extends downward to form a connecting portion 32. The damping plate 37 is integrally molded on the bottom of the connecting portion 32. A periphery of the bottom of the base 31 protrudes downward to form an annular holding plate 33 surrounding and spaced from the connecting portion 32 to define an annular holding channel 35 therebetween. The connecting portion 32 is located in the receiving cavity 111 of the shell 10 and the sidewall of the receiving cavity 111 of the shell 10 is inserted in the holding channel 35 of the tunable element 30.

The inner side of the holding plate 33 protrudes towards the connecting portion 32 to form a plurality of locking blocks 34. The outer side of the sidewall of the receiving cavity 111 of the shell 10 defines an annular holding groove 115 and a plurality of guiding slots 116 apart arranged along a top periphery of the holding groove 115 and corresponding to the locking blocks 34 of the tunable element 30. The guiding slots 116 penetrate through the sidewall of the receiving cavity 111 from top to bottom and communicate with the holding groove 115. The locking blocks 34 pass through the guiding slots 116 and are slidably held in the holding groove 115 to make the tunable element 30 rotatably and removably mounted on the shell 10. In this embodiment, the locking blocks 34 of the tunable element 30 and the guiding slots 116 of the shell 10 are arranged at equal interval in a circle, respectively.

In use, the sound produced by the speaker 20 changes the pressure of the resonance cavity 101, and causes the shake of the damping plate 37. The shake of the damping plate 37 smoothens the frequency response of the sound pressure level in the resonance cavity 101, which adjusts the sound and achieves a better sound effect. As the damping plates 37 made of different materials have the different sound effects, the tunable elements 30 are different by being integrally molded with different damping plates 37. Therefore, when users dissatisfy the sound effect, it is convenient for users to change the sound effect by only changing the tunable elements 30.

As described above, the damping plate 37 is integrally molded on the bottom of the tunable element 30, and then the tunable element 30 together with the damping plate 37 are rotatably and removably mounted on the shell 10. As the damping plates 37 made of different materials have the different sound effects, it is convenient for users to change the sound effect by changing the tunable elements 30 integrally molded with different damping plates 37. So, the user can enjoy different sound effects by only changing the tunable element 30.

What is claimed is:

1. A tunable earphone, comprising:

a speaker for making sound;

a shell receiving the speaker and defining a resonance cavity therein, the shell having a top thereof recessed downward to form a receiving cavity, a supporting plate being formed at a bottom of the receiving cavity, a damping vent being opened in the supporting plate to connect the resonance cavity with the receiving cavity; and a tunable element rotatably and removably mounted on the shell, the tunable element defining a through hole passing therethrough and aligned with the damping vent of the shell, a damping plate being integrally molded on a bottom of the tunable element, the damping plate being located in the receiving cavity and against the supporting plate to separate between the damping vent and the through hole for smoothening the frequency response of the sound pressure level in the resonance cavity while the speaker making sound; and wherein the tunable element has a base, the middle of a bottom of the base extends downward to form a connecting portion, the damping plate is integrally molded on the bottom of the connecting portion, a periphery of the bottom of the base protrudes downward to form an annular holding plate surrounding and spaced from the connecting portion to define an annular holding channel therebetween, the connecting portion is located in the receiving cavity of the shell and the sidewall of the receiving cavity of the shell is inserted in the holding channel of the tunable element.

2. The tunable earphone as claimed in claim 1, wherein the shell includes a bass shell and a high shell coupled with the bass shell, the resonance cavity is divided into a bass cavity formed between the speaker and the bass shell, and a high cavity formed between the speaker and the high shell, the receiving cavity is formed in the top of the bass shell.

3. The tunable earphone as claimed in claim 1, wherein the inner side of the holding plate protrudes towards the connecting portion to form a plurality of locking blocks, the outer side of the sidewall of the receiving cavity of the shell defines an annular holding groove and a plurality of guiding slots apart arranged along a top periphery of the holding groove and corresponding to the locking blocks of the tunable element, the guiding slots penetrate through the sidewall of the receiving cavity from top to bottom and communicate with the holding groove, the locking blocks pass through the guiding slots and are slidably held in the holding groove to make the tunable element rotatably and removably mounted on the shell.

4. The tunable earphone as claimed in claim 3, wherein the locking blocks of the tunable element and the guiding slots of the shell are arranged at equal interval in a circle, respectively.

* * * * *